United States Patent [19]

Brüning

[11] Patent Number: 4,966,468

[45] Date of Patent: Oct. 30, 1990

[54] MIXING DEVICE

[75] Inventor: Werner Brüning, Engelskirchen-Ründeroth, Fed. Rep. of Germany

[73] Assignee: Alfred Fischbach KG, Fed. Rep. of Germany

[21] Appl. No.: 328,362

[22] PCT Filed: Jul. 12, 1988

[86] PCT No.: PCT/EP88/00631

§ 371 Date: Jan. 18, 1989

§ 102(e) Date: Jan. 18, 1989

[87] PCT Pub. No.: WO89/00536

PCT Pub. Date: Jan. 26, 1989

[30] Foreign Application Priority Data

Jul. 15, 1987 [DE] Fed. Rep. of Germany ..... 3723309

[51] Int. Cl.[5] ..... B01F 5/12

[52] U.S. Cl. ..... 366/333; 222/190; 222/386; 366/256; 366/340

[58] Field of Search ..... 366/256, 255, 257, 258, 366/259, 260, 332, 333, 334, 335, 129, 130, 189, 190, 336, 338, 340; 222/190, 386

[56] References Cited

U.S. PATENT DOCUMENTS

| | | | |
|---|---|---|---|
| 3,828,980 | 8/1974 | Creighton | 222/386 |
| 3,858,853 | 1/1975 | Rausch | 366/279 |
| 4,197,967 | 4/1980 | Baur | 222/190 |
| 4,208,133 | 6/1980 | Korte-Jungermann | 366/259 |

*Primary Examiner*—Robert W. Jenkins

*Attorney, Agent, or Firm*—Diller, Ramik & Wight

[57] ABSTRACT

The mixing device is used for mixing multicomponent materials or for homogenizing compositions which are contained in a cartridge (10) which is closed by a piston (15) having a passage opening (19). The latter is primarily closed by the shaft (22) of a mixing member (20). Said shaft (22) may be coupled to a rod (23). By a drive or by manual operation, the rod (23) may be rotated and moved axially at the same time. While the piston (15) stays, where it is, the mixing member (20) is moved through the cartridge (10). Upon termination of the mixing operation, the mixing member (20) is locked at the piston (15) by a holding member (32) in order to unscrew the rod (23) from the mixing member. Subsequently, the cartridge may be inserted into a squeezing tool in which the piston (15) is advanced for squeezing out the composition.

10 Claims, 1 Drawing Sheet

MIXING DEVICE

The invention relates to a mixing device for mixing and homogenizing pasty or flowable compositions.

Prior to being processed, pasty or flowable compositions often require a mixing or homogenizing operation. This is particularly necessary if they consist of more than one component such as synthetic resin and hardener which are combined directly prior to the processing. Such masses are used for inst. as sealing agents or adhesives or as plastic impressive material.

There have been known mixing devices containing a number of components separately accommodated in various compartments. Prior to the blending operation, the compartments are interconnected or a partition wall between the compartments is destroyed or removed thus enabling the components to come into contact. Thereafter, the masses present in a cartridge are treated with a mixing member comprising a rod extending out of the cartridge and adapted to be manually moved axially and to be rotated. Subsequently, the mass contained in the cartridge may be squeezed out by moving out thereof a piston.

The production of the known mixing means is involved and expensive and the mixing effect is mostly unsatisfactory. If several components are contained in one common cartridge, it is always suited for a specific quantitative ratio of the two components only. In other words, such cartridges are useful, but simply for a definite material which requires a specific mixing ratio. Added thereto, the component available in a low amount, is often inflammable. In such a case, the total cartridge must be stored according to fire-protection rules by observing certain safety regulations although only a relatively low percentage of the cartridge content is inflammable.

According to the instant invention, the mixing member is connected through the piston to the rod required for its operation. For the mixing operation, the mixing member is reciprocated in axial direction of the cartridge, and it may be rotated simultaneously about its longitudinal axis. Upon termination of the mixing operation, the mixing member is placed against the piston end wall, and the rod is removed from the mixing member which is retained by the piston. Upon the separation, the mixing member together with the piston forms one sole unit which may be used for squeezing the mixture out of the cartridge. To this effect, use may be made of customary squeezers which normally serve for squeezing sealing substances out of cartridges.

It is a particular advantage that the usual tubular catridges may be used without any modification. The mixing member which, during the mixing operation, is movable separately from the piston, is connected to the latter upon termination of the mixing phase, whereby the mixing member closes the passage opening of the piston thus obtaining a tight end wall of said piston. Upon separation of the rod from the mixing member, the latter forms, so to speak, part of the piston, and, during the following squeezing operation, it is not moved independently. In a way, the piston is completed by the mixing member fixed thereto. During mixing, the piston serves as an element for closing the cartridge and for guiding and sealing the rod. In the delivery state, the mixing member may be also joined to the piston, unless the rod is connected to the mixing member. For the mixing operation, the rod is connected to the mixing member which is retained by the piston. By an axial advance of the rod, the connection between the mixing member and the piston is cleared thus enabling the mixing member to freely operate, while the passage opening of the piston is sealed against the rod thus preventing the mass from escaping from the cartridge along the rod.

It is preferable to provide the mixing member with a hollow shaft which is sealingly received by a sleeve projecting rearwardly from the front piston surface. The outer diameter of the shaft is equal to that of the rod connectable therewith. The connection between rod and hollow shaft is preferably realised by threads, in particular by a multiple thread.

The mixing member comprises a flat disk with openings and blades adapted to swing out of the disk plane and, preferably, the mutually confronted or averted edges of two blades are hinge-connected with the disk. The blades which, responsive to the axial travel motion of the mixing member, are swivelled through the pasty composition, are always set in such a way that, upon rotation of the mixing member in one sense of rotation, one of the two mentioned blades helically cuts its path through the composition, while the other blade offers an increased flow resistance. As a result, it is ensured that the mixing member does not helically cut the composition against a low resistance only, but the agitative effect on the mass caused by at least one of the blades is quite considerable.

The mixing apparatus of the invention may be used for homogenizing one of the compositions contained in the cartridge, prior to being used. In such a case, the total mass is contained in the cartridge. It is also possible to mix several components. In such a case, the component constituing the major portion of the mixture is already contained in the cartridge, while the other component is added later. The smaller component amount may be fed later through the spout provided in the cartridge end wall and later used for sequeezing. Of course, said spout should be closed by a cap during the mixing operation.

One embodiment of the invention will be now explained hereunder in more detail with reference to the drawings in which.

Figure 1:
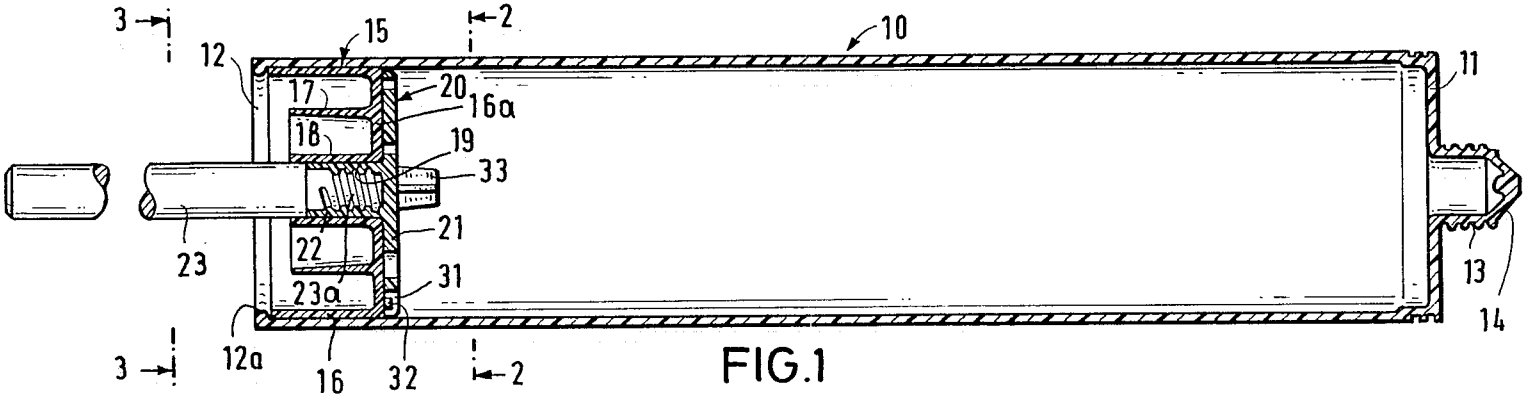
FIG. 1 is a longitudinal section of the mixing apparatus.
Figure 3:
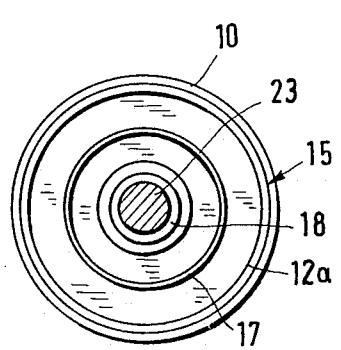
FIG. 3 is a section along line 3—3 of FIG. 1.
Figure 4:
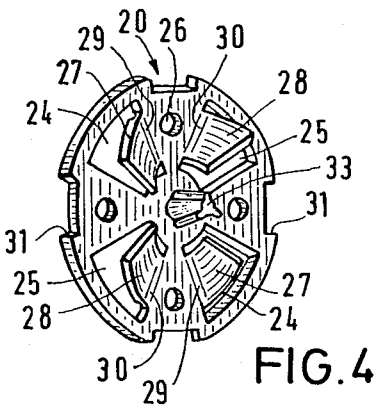
FIG. 4 is a perspective view of the mixing member.
Figure 2:
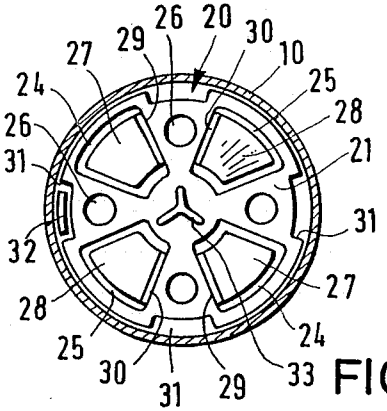
FIG. 2 is a section along line 2—2 of FIG. 1.

The illustrated mixing apparatus comprises a customary cartridge 10 which consist of a molded part, of metal or of paper material, formed as an elongated, cylindrical tube closed at its one end by a wall 11, while the opposite end 12 is open. The end wall 11 is provided with a spout 13 having an external thread through which the mass may be expelled out of the cartridge. In the illustrated condition, spout 13 is closed by a detachable wall 14.

The cartridge 10 accommodates a piston 15 whose cylindrical circumferential wall 16 sealingly rests against the inner cartridge wall. From the plane front piston surface **16*a* forming the end wall, there project rearwardly resp. outwardly the peripheral wall 16, an annular reinforcing wall 17, and a sleeve 18, the peripheral wall 16 exceeding towards the end the reinforcing wall 17 and the sleeve 18. Only the front ends of all of said three walls 16, 17, 18 are connected to the piston wall 16*a*, while the rear ends project freely. Sleeve 18** encloses the passage opening 19 which axially traverses piston 15.

Upon the insertion of piston 15 into the cartridge 10 through the open end 12, the latter is deformed such as to bring about a stop 12*a* retaining the piston in the cartridge. The cartridge is filled through the open spout 13 whose wall 14 is removed.

The passage opening 19 of piston 15 is closed by the mixing member 20 comprising an interrupted disk 21 flatly resting against the piston wall 16 and whose outer diameter is somewhat inferior to that of piston 15. From the rear side of disk 21, a hollow shaft 22 extends to the rear, said shaft 22 filling completely and tightly the cross section of sleeve 19. Inside said shaft 22, there is an internal thread into which the thread piece 23*a* at the front end of rod 23 is screwed. The threads of sleeve 18 and of thread piece 23*a* are of the double type. Due to such a thread design, by rotating the rod 23, the meshing of the threads may be detected more easily and the threads may be tightened more quickly. The shaft 22 does not extend as far as to the rear end of sleeve 18. Into said end, there extends the main part of rod 23 which is behind the thread piece 23*a* and whose diameter is equal to that of shaft 22.

The disk 21 comprises a number of openings 24, 25, 26, among which openings 24 and 25 contain blades 27 or 28 which, by film hinges 29 and 30 are connected integrally with the disk 21. As for blades 27 arranged oppositely, the film hinges 29 are disposed at the radial edges being forwardly directed clockwise, while the film hinges 30 at blades 28 are disposed at the radial edge being forwardly directed anticlockwise. If the mixing member 20 is axially moved in the cartridge 10, all of the four blades 27, 28 are folded outwardly counter to the travel direction. If the mixing member is rotated at the same time, only two of said blades point to the sense of rotation, while the remaining blades indicate to the counterdirection. Thus, a helical cutting of the blades into the pasty composition is avoided and, by the blades pointing in counterdirection, an agitating effect on the mass is ensured.

The openings 26 are simple holes. The periphery of disk 21 is provided with uniformly distributed recesses 31 designed as peripheral slots radially open outwardly. Each recess 31 may coact with a holding member 32 of piston 15, the holding member 32 being a shoulder forwardly projecting from the piston surface 16*a* and dipping into a recess 31 when disk 21 rests against the piston surface 16*a*. In such a case, the holding member 32 forms a resistance to rotation inhibiting a rotation of disk 21 relative to piston 15. By this means, the rod 23 may be unscrewed from the mixing member 20, while the latter is retained against rotation by the holding member 32 of the piston 15, whose peripheral wall 16 frictionally supports itself inside the cartridge 10, whereby the torsional resistance is so high that the piston 15 is not turned when the rod 23 rotates within the cartridge 10. The shoulder may be saw-tooth shaped so that the mixing member 20 is blocked relative to the piston 15 but only in one sense of rotation, while it may rotate in the other direction. If bar 23 is rotated in the release direction, mixing member 20 should be prevented from rotating by the holding member 32.

The mixing device is supplied in the condition shown in FIG. 1, with the exception that shaft 23 is not screwed in place, while the composition to be squeezed out or one component of said mass may be inside cartridge 10.

In operation of the mixing device, wall 14 of spout 13 may be cut off for the introduction of an additional component into the cartridge 10. Subsequently, spout 13 is closed by a (non-illustrated) screw cap. Now, one only needs to screw rod 23 into shaft 22 of the mixing member. Thereafter, rod 23 may be connected to a driving unit, e.g. a portable drill to rotate the rod and the mixing member 20 at the same time. During such a rotation, the threads of thread pieces 23*a* and shaft 22 are tightened. As a result, rod 23 may be moved axially through cartridge 10, while all cartridge areas are subjected to the mixing effect. As for blades 27, 28 of the mixing member 20, they are automatically adjusted such that, with respect to the axial movement, they point to the rear.

Upon termination of the mixing or homogenizing operation, the mixing member 20 is withdrawn until it rests against the piston surface 16. Now, rod 23 is turned counter to its preceding sense of rotation in order to release the thread engagement with the mixing member 20 which, at the same time finds its support by the holding member 32, while shaft 22 seals the passage opening 19 of piston 15. Upon removal of rod 23, the cartridge 10 may be mounted into a usual squeezing tool, such as a spray gun in order to squeeze the cartridge content out of the spout 13.

The mixing member 20 is provided with an axial attachment 33 projecting forwardly and being adapted to penetrate, during mixing, into the interior of the spout 13, in order to also displace the mass present there. The cross section of the attachment 33 is out of round; in the instant embodiment, it consists of three star-shaped ribs. When the material is squeezed out of the cartridge, the mass present in the spout 13 is expelled by said attachment 33.

What is claimed is:

1. Mixing device for mixing or homogenizing pasty or flowable compositions comprising a tubular cartridge (10), having at its one end a front wall (11), while its other end (12) is open, a mixing member (20) accommodated in the cartridge (10) and connected to a rod (23) extending out of the open cartridge end, and a piston (15) for squeezing out the cartridge content, characterized in that the piston (15) has an axial passage opening (19) for the rod (23) or for a shaft (22) projecting from the mixing member (23), the rod (23) is detachably connected to the mixing member (20), the piston (15) includes a holding member (32), and said holding member (32) defines means for retaining the mixing member (20) against rotation as said mixing member (20) is separated from the rod (23).

2. Mixing device as set forth in claim 1, characterized in that the piston (15) includes a sleeve (18) projecting to the rear from the piston surface (16*a*) and forming a seat for a hollow shaft (22) provided at the mixing member (20), the shaft (22) containing a coupling means for the connection with rod (23).

3. Mixing device as set forth in claim 2, characterized in that the coupling means is a thread.

4. Mixing device as set forth in claim 3, characterized in that the thread is at least a double thread.

5. Mixing device as set forth in claim 1, characterized in that the holding member (32) is a projection engaging as an antirotation protection a recess (31) of the mixing member (20).

6. Mixing device as set forth in claim 5, characterized in that the projection is saw tooth-shaped to retain the mixing member (20) only in release direction of the rod (23) relative to the piston (15).

7. Mixing device as set forth in claim 1, characterized in that the mixing member (20) is a disk (21) provided with openings (24,25,26), among which some openings (24,25) contain blades (27,28) adapted to swing out of the disk plane.

8. Mixing device as set forth in claim 7, characterized in that at least two blades (27,28) are hinge-connected to the disk (21) at their mutually confronted or averted radial edges.

9. Mixing device as set forth in claim 1, characterized in that the mixing member (20) includes an axial attachment (33) having an out-of-round profile which penetrates a squeezing spout (13) at the end wall (11) of the cartridge (10).

10. Mixing device as set forth in claim 1, characterized in that a stop (12*a*) at the rear end (12) of the cartridge (10) is provided to avoid the escape of piston (15).

* * * * *